US007787782B2

(12) United States Patent
Takada

(10) Patent No.: US 7,787,782 B2
(45) Date of Patent: Aug. 31, 2010

(54) IMAGE FORMING APPARATUS

(75) Inventor: Akihiro Takada, Kawachinagano (JP)

(73) Assignee: Kyocera Mita Corporation, Osaka (JP)

( * ) Notice: Subject to any disclaimer, the term of this patent is extended or adjusted under 35 U.S.C. 154(b) by 524 days.

(21) Appl. No.: 11/767,687

(22) Filed: Jun. 25, 2007

(65) Prior Publication Data

US 2007/0297815 A1 Dec. 27, 2007

(30) Foreign Application Priority Data

Jun. 23, 2006 (JP) ..... 2006-173961

(51) Int. Cl.
*G03G 15/00* (2006.01)

(52) U.S. Cl. ..... 399/12; 399/24; 399/49; 399/72

(58) Field of Classification Search ..... 399/12, 399/24, 49, 72
See application file for complete search history.

(56) References Cited

U.S. PATENT DOCUMENTS 7,194,212 B2 * 3/2007 Kumai et al. ..... 399/12
7,239,815 B2 * 7/2007 Takahashi ..... 399/12
7,317,880 B2 * 1/2008 Taguchi et al. ..... 399/12
2005/0254835 A1 * 11/2005 Takei ..... 399/12
2008/0008486 A1 * 1/2008 Saida et al. ..... 399/49

FOREIGN PATENT DOCUMENTS

JP 2001-125462 5/2001
JP 2005-115054 4/2005

* cited by examiner

*Primary Examiner*—David M Gray
*Assistant Examiner*—Francis Gray
(74) *Attorney, Agent, or Firm*—Ditthavong Mori & Steiner, P.C.

(57) ABSTRACT

The image forming apparatus comprises a replaceable consumable, a determination unit for determining whether the consumable is non-genuine (S12), a first image-quality adjustment unit, and a second image-quality adjustment unit. When the determination unit determines that the consumable is non-genuine (YES in S12), the first image-quality adjustment unit performs an image-quality adjustment suitable for the non-genuine consumable (S13). When the determination unit determines that the consumable is genuine (No in S12), the second image-quality adjustment unit performs an image-quality adjustment suitable for the genuine consumable (S14).

4 Claims, 4 Drawing Sheets

IMAGE FORMING APPARATUS

BACKGROUND OF THE INVENTION

1. Field of the Invention

This invention relates to an image forming apparatus, and more particularly relates to an image forming apparatus that uses replaceable consumables.

2. Description of Background Art

When an image forming apparatus is used as a copying machine, an electrostatic latent image is formed on a photoreceptor, a toner is supplied to be adhered to the electrostatic latent image in order to make it visible, and the image is transferred with the toner onto a sheet of paper to produce an output image. Outputs of images consume toner, and therefore the consumed toner should be supplied from outside supply sources. Generally, the consumed toner is supplied by replacing the empty toner cartridge with a toner cartridge filled with toner.

Toner serves as a component for forming images and has various features. For example, toner has a charging performance and a particle size distribution to improve the image quality. The surface property of toner functions to prevent a photoreceptor and a developing unit from damage. The features that the toner should have depend on the image forming apparatus and the photoreceptor and developing unit contained therein. Specifically, the use of genuine toner suitable for the image forming apparatus prevents the photoreceptor and other units from damage and can create high-quality images. These sorts of toner are manufactured by people well-versed in the toner features, such as manufacturers of the image forming apparatuses.

However, some people, who are ill-versed in the toner features, manufacture and sell toner. Such "non-genuine toner" that is formed by analyzing and imitating toner manufactured by the image forming apparatus manufacturer, that is to say "genuine toner", is passable to form visible images. However, because non-genuine toner does not have exactly the same features as genuine toner, it is very difficult to obtain high-quality images with the use of non-genuine toner. Besides, such non-genuine toner may badly wear the photoreceptor, for example, resulting in failure of the image forming apparatus.

Japanese unexamined patent publication No. 2001-125462 discloses a technique to determine whether a cartridge is an improper cartridge that has been refilled with consumables. The image forming apparatus according to the publication is designed to detect whether or not the cartridge loaded in the image forming apparatus is proper, and prohibit the printing operation when the cartridge is improper.

Most users who use the non-genuine toner to output images hardly notice the above-described failure caused by the non-genuine toner. This puts users at a disadvantage. In addition, the use of non-genuine toner in the same manner as genuine toner does not provide high-quality images.

SUMMARY OF THE INVENTION

The present invention has an object to provide an image forming apparatus capable of forming images of as good quality as possible even if the consumable is non-genuine and reducing the possibility of failures.

The image forming apparatus according to the present invention comprises a replaceable consumable, a determination unit for determining whether the consumable is non-genuine, and a first image-quality adjustment unit for adjusting image quality. When the determination unit determines that the consumable is non-genuine, the first image-quality adjustment unit performs an image-quality adjustment suitable for the non-genuine consumable.

More preferably, the consumable is provided with an IC tag storing information that the consumable is genuine. The determination unit reads the information stored in the IC tag and determines whether the consumable is non-genuine or genuine based on the information.

More preferably, the consumable includes a toner cartridge filled with toner. The first image-quality adjustment unit adjusts image quality by supplying toner that adheres to an electrostatic latent image used for adjusting the image quality. The electrostatic latent image is formed on a photoreceptor.

More preferably, the first image-quality adjustment unit adjusts image quality by increasing aging time.

More Preferably, the image forming apparatus comprises a second image-quality adjustment unit. When the determination unit determines that the consumable is genuine, the second image-quality adjustment unit performs an image-quality adjustment suitable for the genuine consumable. The consumable includes a toner cartridge filled with toner. The first image-quality adjustment unit adjusts image quality by supplying non-genuine toner that adheres to a first electrostatic latent image including a plural number of pattern images and used for adjusting the image quality. The first electrostatic latent image is formed on a photoreceptor. The second image-quality adjustment unit adjusts image quality by supplying genuine toner that adheres to a second electrostatic latent image including a plural number of pattern images and used for adjusting the image quality. The second electrostatic latent image is formed on a photoreceptor. The number of pattern images included the first electrostatic latent image is larger than the number of pattern images included the second electrostatic latent image.

More Preferably, the image forming apparatus comprises a second image-quality adjustment unit. When the determination unit determines that the consumable is genuine, the second image-quality adjustment unit performs an image-quality adjustment suitable for the genuine consumable. The consumable includes a toner cartridge filled with toner. The first image-quality adjustment unit adjusts image quality by supplying non-genuine toner that adheres to a first electrostatic latent image including a plural number of strip-shaped pattern images and used for adjusting the image quality. The first electrostatic latent image is formed on a photoreceptor. The second image-quality adjustment unit adjusts image quality by supplying genuine toner that adheres to a second electrostatic latent image including a plural number of strip-shaped pattern images and used for adjusting the image quality. The second electrostatic latent image is formed on a photoreceptor. An area of pattern images included the first electrostatic latent image is larger than an area of pattern images included the second electrostatic latent image.

More Preferably, the image forming apparatus comprises a second image-quality adjustment unit. When the determination unit determines that the consumable is genuine, the second image-quality adjustment unit performs an image-quality adjustment suitable for the genuine consumable. The consumable includes a toner cartridge filled with toner. The first image-quality adjustment unit adjusts image quality by supplying non-genuine toner that adheres to a first electrostatic latent image including a plural number of pattern images that have differences in surface potential thereamong and used for adjusting the image quality. The first electrostatic latent image is formed on a photoreceptor. The second image-quality adjustment unit adjusts image quality by supplying genuine toner that adheres to a second electrostatic latent image including a plural number of pattern images that have differences in surface potential thereamong and used for adjusting the image quality. The second electrostatic latent image is formed on a photoreceptor. A difference in surface potential of pattern images thereamong included the first electrostatic latent image is smaller than a difference in surface potential of pattern images thereamong included the second electrostatic latent image.

According to the present invention, when the consumable is determined to be non-genuine, an image-quality adjustment suitable for the non-genuine consumable is performed. Therefore, even if the consumable is non-genuine, it is possible to form images of as good quality as possible.

DESCRIPTION OF PREFERRED EMBODIMENT

Figure 1:
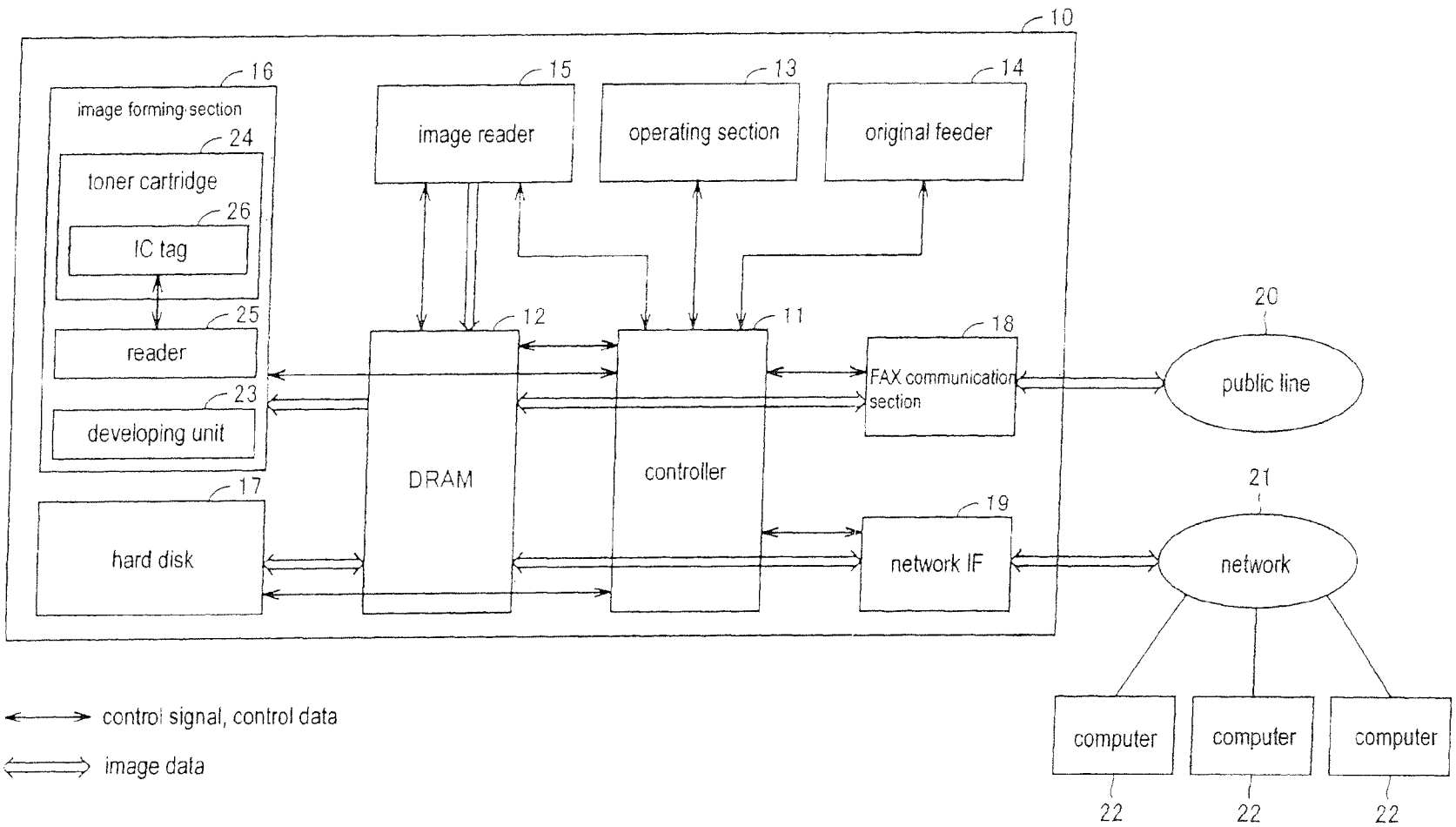
FIG. 1 is a block diagram of the general structure of a multifunctional printer according to an embodiment of this invention.

An embodiment of the present invention will be described below by referring to the drawings. FIG. 1 is a block diagram showing the structure of a multifunctional printer 10 to which an image forming apparatus according to the embodiment of the invention is applied. Referring to FIG. 1, the multifunctional printer 10 includes a controller 11 for controlling the entire multifunctional printer 10, DRAM 12 for reading and writing image data or other data, an operating section 13 containing a display for indicating information stored in the multifunctional printer 10 and serving as an interface between the multifunctional printer 10 and a user, an original feeder 14 for automatically transferring an original to a predetermined reading position, an image reader 15 including a scanner that reads the image of the original transferred by the original feeder 14 at the predetermined reading position, an image forming section 16 for forming an image based on the image of the original scanned by the image reader 15, a hard disk 17 for storing the image data and so on, a FAX communication section 18 connected to a public line 20, and a network IF (interface) 19 for connecting the multifunctional printer 10 and a network 21.

The controller 11 compresses and encodes data of the original fed by the image reader 15 and writes the encoded data in the DRAM 12. The controller 11 also reads out the data written in the DRAM 12 and decompresses and decodes the read-out data to output from the image forming section 16.

When the multifunctional printer 10 is activated as a copying machine, the multifunctional printer 10 forms an image in the image forming section 16 based on original image data which is read by the image reader 15 and sent through the DRAM 12. When the multifunctional printer 10 is activated as a printer, the multifunctional printer 10 forms an image in the image forming section 16 based on original image data which is transmitted from personal computers 22 connected to the network 21 through the network IF 19 and the DRAM 12. Furthermore, when the multifunctional printer 10 is activated as a facsimile machine, the multifunctional printer 10 forms an image in the image forming section 16 based on image data transmitted from the public line 20 through the FAX communication section 18 and the DRAM 12, while transmitting original image data, which is read by the image reader 15, through the DRAM 12 and the FAX communication section 18 to the public line 20.

In FIG. 1, double-line arrows indicate flows of image data, while thin-line arrows indicate flows of control signals or control data.

Figure 2:
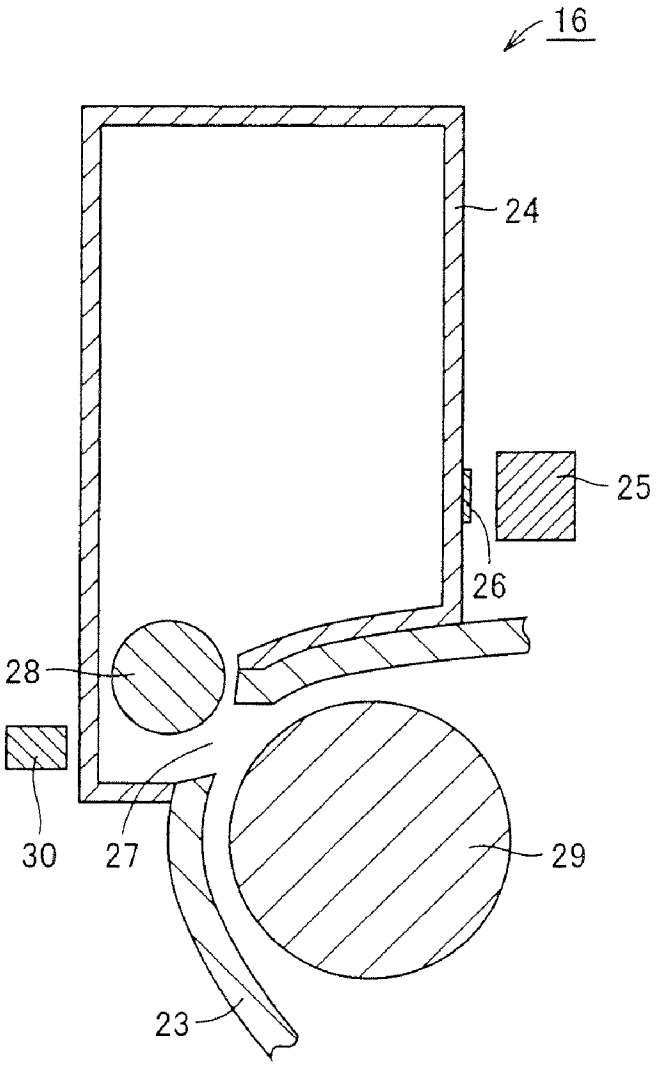
FIG. 2 is a schematic cross-sectional view of an image forming section that is cross-sectioned by a plane perpendicular to a rotation axis of a photoreceptor and lying in the middle of the image forming section.

FIG. 2 is a schematic cross-sectional view of the image forming section 16 in the multifunctional printer 10, the image forming section 16 being cross-sectioned by a plane perpendicular to a rotation axis of a photoreceptor. Referring to FIGS. 1 and 2, the image forming section 16 comprises a developing unit 23, a photoreceptor (not shown), a toner cartridge 24 and a reader 25.

The image forming section 16 supplies toner from the developing unit 23 onto the surface of the photoreceptor on which light is irradiated and an electrostatic latent image is formed in order to develop the image. The developing unit 23 contains a developer (not shown). The developer in use is a two-component developer composed of toner particles and magnetic carrier particles. With the developing process, toner in the developing unit 23 is consumed and then toner in the toner cartridge 24 is supplied into the developing unit 23 by the amount of the toner consumed.

The toner cartridge 24 is mounted on the upper part of the developing unit 23. The toner cartridge 24 is filled with toner which will be consumed in the developing unit 23. The toner is supplied from the toner cartridge 24 through a toner supply port 27 into the developing unit 23 by means of a rotatable supply roller 28 provided in the toner cartridge 24. The toner supplied in the developing unit 23 is transferred to certain parts in the developing unit 23 by means of a rotatable transfer roller 29 provided in the developing unit 23, while being mixed with the carrier particles in the developing unit 23 to carry an electric charge.

The amount of toner remaining in the toner cartridge 24 is detected by a remaining toner detection sensor 30 provided on the developing unit 23. The toner cartridge 24 is replaceable. Specifically, a user can replace an empty toner cartridge 24 with a new toner cartridge 24 filled with toner.

The toner cartridge 24 is provided with an IC tag 26. The IC tag 26 is positioned on the outside of the toner cartridge 24 and where the reader 25 can read it. The IC tag 26 stores information regarding the toner cartridge 24, which can validate that the toner cartridge 24 is a genuine product. The information regarding the toner cartridge 24 includes the specification of the toner filled in the toner cartridge 24, the manufacturer, date of manufacture and so on. The reader 25 can read out the information stored in the IC tag 26 and write information into the IC tag 26.

Accordingly, the determination of whether the toner cartridge 24 is genuine or not can be easily and reliably made by reading out the information stored in the IC tag 26. Here, "a genuine toner cartridge 24" refers to a toner cartridge that is provided with an IC tag 26 storing true information. Whether stored information is true or not is determined by reading the contents of the IC tag 26. On the other hand, "a non-genuine toner cartridge 24" refers to a toner cartridge that is not provided with the IC tag 26 or a toner cartridge that is provided with an IC tag 26 storing wrong information.

Figure 3:
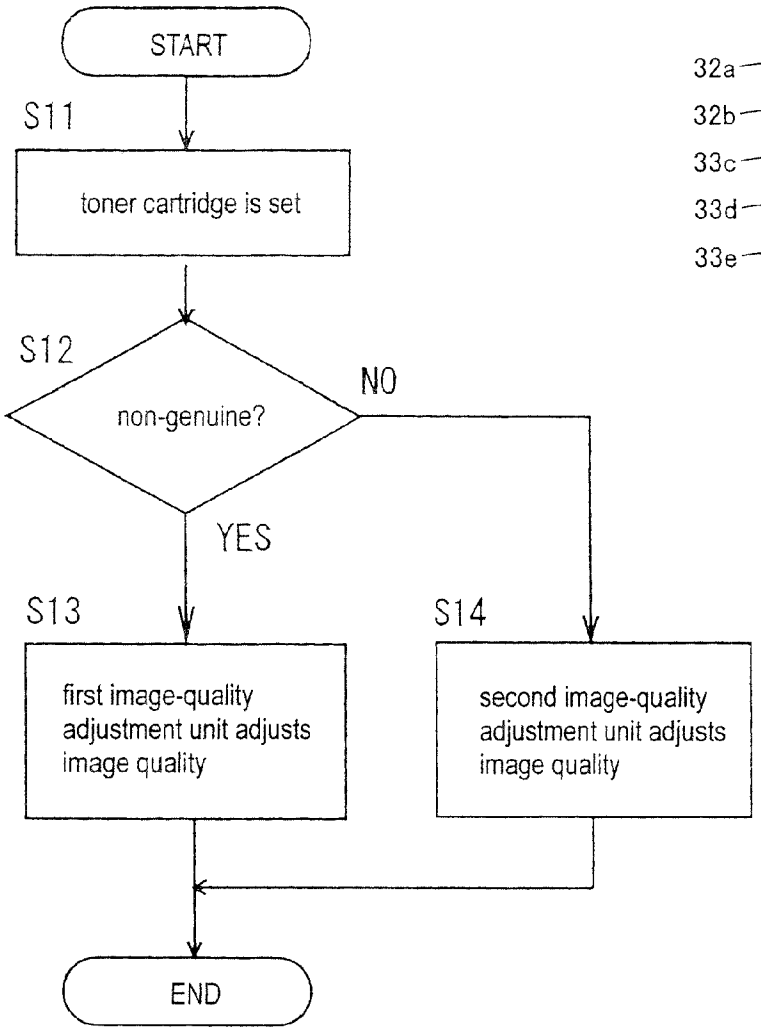
FIG. 3 is a flow chart illustrating the operation of a controller when a toner cartridge is loaded.

Next, a description will be made about the process in which a new toner cartridge 24 is loaded and an image is formed. FIG. 3 is a flow chart illustrating the operation of the controller 11 in the process. Referring to FIGS. 1 to 3, a new toner cartridge 24 is set in the multifunctional printer 10 and loaded (step S11 in FIG. 3, and hereinafter "step" will be omitted).

When the controller 11 recognizes that the toner cartridge 24 is loaded, the controller 11 determines whether the loaded toner cartridge 24 is non-genuine or not, in other words, whether the loaded toner cartridge 24 is a non-genuine product or genuine product (S12). Specifically, the controller 11 determines whether the reader 25 can read information of the IC tag 26 attached to the toner cartridge 24 and further whether the information of the IC tag 26 read by the reader 25 is true or not.

If there is no IC tag 26 on the toner cartridge 24, the controller 11 determines that the loaded toner cartridge 24 is non-genuine because the reader 25 cannot read the information of the IC tag 26. The controller 11 also determines that the loaded toner cartridge 24 is non-genuine when the information read out from the IC tag 26 is wrong. When the information read out from the IC tag 26 is true, the controller 11 determines that the toner cartridge 24 is genuine. In this step, the controller 11, reader 25 and IC tag 26 operate as a determination unit.

Figure 4:
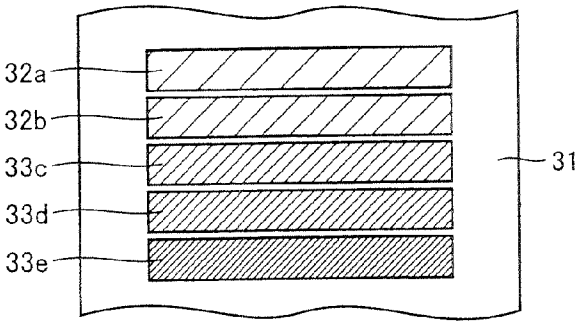
FIG. 4 illustrates a part of an electrostatic latent image, formed on the photoreceptor, for non-genuine toner cartridges.

Next, a description will be made about the process when the toner cartridge 24 is determined to be non-genuine. When the controller 11 determines that the toner cartridge 24 is non-genuine (YES in S12), a first image-quality adjustment unit adjusts image quality (S13). The image-quality adjustment by the first image-quality adjustment unit includes irradiation of light onto the charged photoreceptor to form a first electrostatic latent image used for adjusting image quality. FIG. 4 illustrates one example of the first electrostatic latent image which is used for adjusting image quality and formed on the photoreceptor. Referring to FIG. 4, the first electrostatic latent image on the photoreceptor 31 includes five strip-shaped pattern images 32*a*, 32*b*, 32*c*, 32*d*, and 32*e*. Each of the pattern images 32*a* to 32*e* has a large area. The pattern images 32*a* to 32*e* are formed so as to have no great differences in surface potential thereamong.

Because the features of the non-genuine toner are unclear, it is uncertain if the toner can create good-quality images. For example, even if the toner may be able to create a good-quality image on a part of the surface of the photoreceptor 31, the image quality could be deteriorated on the other parts. Therefore, the pattern images 32*a* to 32*e* should be large enough to adjust the image quality. In addition, a certain large degree of the surface-potential differences may be able to provide a good-quality image, however, the small surface-potential differences may be not allowed to form good-quality images. Therefore, the image-quality adjustment should be made using the pattern images with small differences in surface potential thereamong.

Then the non-genuine toner is adhered to thus formed pattern images 32*a* to 32*e*. The non-genuine toner, which has been charged in the developing unit 23, is attracted according to the surface potentials of the pattern images 32*a* to 32*e*. Next, a density sensor (not shown) provided in the image forming section 16 detects the density of the non-genuine toner adhered to each of the pattern images 32*a* to 32*e*. Then, the toner density figured out from the surface potentials of the pattern images 32*a* to 32*e* formed on the photoreceptor 31 is compared with the toner density detected by the density sensor in order to obtain the difference between them. The controller 11 determines whether the difference between the toner densities is in an acceptable range. In other words, the controller 11 determines whether the difference is in a range where a good-quality image is available.

When the difference is not in the acceptable range, the charge quantity of the non-genuine toner is adjusted, for example. Specifically, the charge quantity can be adjusted by increasing the aging time, in other words, a time period to rotate an agitation roller (not shown) in the developing unit 23. By sufficiently mixing the toner particles and carrier particles in the developing unit 23, the toner particles are triboelectrically charged and further increase their charge quantity. After the charge quantity of the toner is increased in this way, the same steps mentioned above are performed to compare the toner densities and obtain the difference between them. This image-quality adjustment will be repeatedly performed until the toner density falls within the acceptable range. If the toner density does not fall in the acceptable range even after the same steps have been done several times, image forming conditions to obtain an image of as good quality as possible is derived. The image-quality adjustment is thus performed for the non-genuine toner. Here, the controller 11 operates as the first image-quality adjustment unit. The first image-quality adjustment unit is activated at predetermined times, for example, at a time when the multifunctional printer 10 is turned on.

Accordingly, this multifunctional printer 10 can form images of as good quality as possible for the non-genuine toner.

Figure 5:
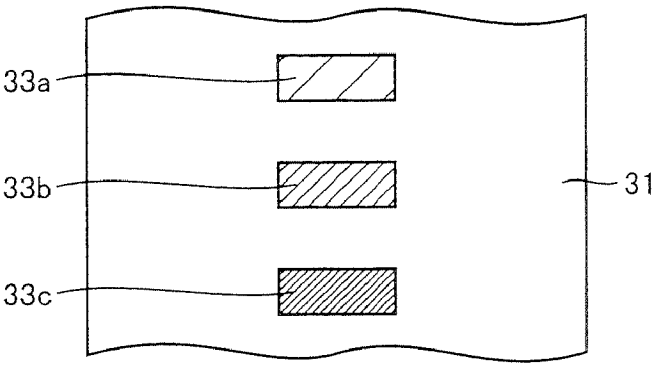
FIG. 5 illustrates a part of an electrostatic latent image, formed on the photoreceptor, for genuine toner cartridges.

Next, a description will be made about the process when the toner cartridge 24 is determined to be genuine. When the controller 11 determines that the toner cartridge 24 is genuine (NO in S12), a second image-quality adjustment unit adjusts image quality (S14). FIG. 5 illustrates one example of a second electrostatic latent image which is used for adjusting the image quality and formed on the photoreceptor in order for the second image-quality adjustment unit to adjust the image quality. FIG. 5 corresponds to FIG. 4. Referring to FIG. 5, the second electrostatic latent image used for adjusting image quality includes three strip-shaped pattern images 33*a*, 33*b* and 33*c*. Each of the pattern images 33*a* to 33*c* has less area than each of the pattern images 32*a* to 32*e*. The pattern images 33*a* to 33*c* are so formed as to have greater differences in surface potential thereamong than the pattern images 32*a* to 32*e*. In other words, the number of pattern images included the first electrostatic latent image is larger than the number of pattern images included the second electrostatic latent image. An area of pattern images included the first electrostatic latent image is larger than an area of pattern images included the second electrostatic latent image. A difference in surface potential of pattern images thereamong included the first electrostatic latent image is smaller than a difference in surface potential of pattern images thereamong included the second electrostatic latent image. The process after the formation of the electrostatic latent image is the same as the one the first image-quality adjustment unit has done. The image-quality adjustment for the genuine toner is made in this way. Here, the controller 11 operates as a second image-quality adjustment unit. The second image-quality adjustment unit is also activated at predetermined times.

Because the features of the genuine toner are explicit, it can be expected that images of a certain degree of high quality can be formed. Therefore, the image-quality adjustment using the above-described electrostatic latent image can help form high-quality images.

Accordingly, this multifunctional printer 10 can form images of as high quality as possible for the genuine toner.

It may be possible to set the first image-quality adjustment unit to be activated more often than the second image-quality adjustment unit in a predetermined period. For example, the first image-quality adjustment unit is set to be activated every time an image to be output is formed. On the other hand, the second image-quality adjustment unit is set to be activated every time thousands of images are formed since the toner cartridge 24 has been loaded. Because the genuine toner has features suitable for the multifunctional printer 10, frequent image-quality adjustments are not needed to form high-quality images. On the contrary, because the non-genuine toner does not have the features suitable for the multifunctional printer 10, it is uncertain, even just after an image is output, whether the same quality image can be formed.

Figure 6:
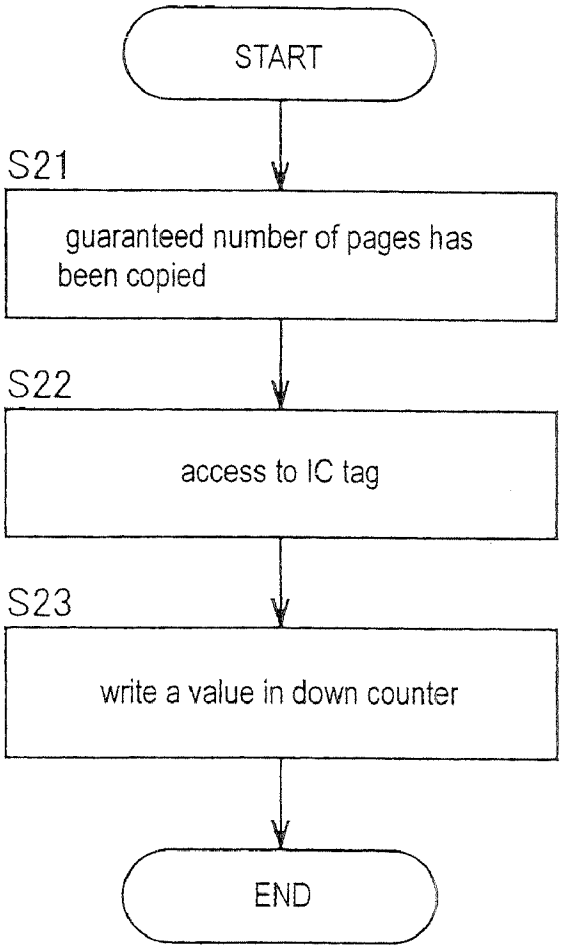
FIG. 6 is a flow chart illustrating the operation of the controller to rewrite the value of a down counter into an IC tag.

When the genuine toner cartridge 24 is loaded and completes the guaranteed number of pages that can be printed from the cartridge, it may be possible to set the IC tag 26 to store the information about the completion of the guaranteed number of pages. FIG. 6 is a flow chart illustrating the operation of the controller 11 to complete this process. Referring to FIG. 6, when the guaranteed number of pages that can be printed from the genuine toner cartridge 24 is completed (S21), the reader 25 accesses to the IC tag 26 attached on the toner cartridge 24 (S22). Then, the reader 25 writes a value in a down counter provided in a storage area of the IC tag 26 to be incremented by 1 (S23). This down counter is to be incremented by 1 upon completion of the guaranteed number of pages and store the incremented value in the storage area of the IC tag 26. An initial count of the down counter is zero. In this way, the down-counter information is rewritten and stored in the IC tag 26.

This allows the controller 11 to read the down-counter information in the IC tag 26 when a new toner cartridge 24 is loaded, and to determine whether the toner cartridge 24 has been used to copy the guaranteed number of pages. Some non-genuine products are made by refilling non-genuine toner into a genuine toner cartridge 24 that has been used to copy the guaranteed number of pages. In this case, since the genuine toner cartridge 24 is refilled with the non-genuine toner, reading only the information stored in the IC tag 26 may cause the controller 11 to make a wrong determination. However, the controller 11 can determine whether the toner refilled in the toner cartridge 24 is non-genuine by reading the down-counter information.

By the way, in the case where the manufacturer of the multifunctional printer 10 collects empty genuine toner cartridges 24 and refills genuine toner into the cartridges, the down-counter information stored in the IC tag 26 is rewritten as well, and therefore the toner cartridge 24 can be determined as a genuine toner cartridge.

In the above-discussed embodiment, the toner cartridge filled with toner is cited as a replaceable consumable, the present invention is not limited to this and can be applied to the other consumables such as a photoreceptor and a developing system incorporating a photoreceptor and developing unit. Specifically, when a photoreceptor, which is a consumable, is determined to be non-genuine, for example, the image forming apparatus adjusts image quality by changing the amount of light to be irradiated to the photoreceptor and the charge quantity of toner with respect to the setup programmed for a genuine photoreceptor in order to obtain images of as high quality as possible.

In the above-discussed embodiment, the determination unit, which comprises an IC tag, a reader and a controller, determines whether the consumable is non-genuine or not, the present invention is not limited to this. The determination whether the consumable is non-genuine also can be made through other methods, for example, by providing a distinctive part to consumables and identifying the distinctive part by means of the controller.

Furthermore, the image quality is adjusted by supplying toner that adheres to the electrostatic latent image used for adjusting the image quality and comparing the toner densities to obtain the difference therebetween in the above-discussed embodiment, however, the present invention is not limited to this. The image-quality adjustment can be made through other methods. Yet furthermore, the description of the above-discussed embodiment is made for an image-quality adjustment when toner is determined to be genuine or not, however, the present invention is not limited to this. When it is determined whether the photoreceptor is genuine or not, the image-quality adjustment also can be performed, for example, by measuring surface potential at several points on the photoreceptor and comparing the surface potentials to obtain the differences thereamong.

Yet furthermore, the image forming apparatus can be set not to allow the first image-quality adjustment unit to adjust image quality when the replaceable consumable is determined to be genuine.

The foregoing has described the embodiments of the present invention by referring to the drawings. However the invention should not be limited to the illustrated embodiments. It should be appreciated that various modifications and changes can be made to the illustrated embodiments within the scope of the appended claims and their equivalents.

What is claimed is:

1. An image forming apparatus comprising:

a replaceable consumable;

a determination unit for determining whether said consumable is non-genuine;

a first image-quality adjustment unit for adjusting image quality, wherein when said determination unit determines that said consumable is non-genuine, said first image-quality adjustment unit performs an image-quality adjustment suitable for said non-genuine consumable; and a second image-quality adjustment unit for adjusting image quality, wherein when said determination unit determines that said consumable is genuine, said second image-quality adjustment unit performs an image-quality adjustment suitable for said genuine consumable, wherein said consumable includes a toner cartridge filled with toner, said first image-quality adjustment unit adjusts image quality by supplying non-genuine toner that adheres to a first electrostatic latent image including a plural number of pattern images and used for adjusting the image quality, said first electrostatic latent image being formed on a photoreceptor, said second image-quality adjustment unit adjusts image quality by supplying genuine toner that adheres to a second electrostatic latent image including a plural number of pattern images and used for adjusting the image quality, said second electrostatic latent image being formed on a photoreceptor, and the number of pattern images included said first electrostatic latent image is larger than the number of pattern images included said second electrostatic latent image.

2. An image forming apparatus comprising:

a replaceable consumable;

a determination unit for determining whether said consumable is non-genuine;

a first image-quality adjustment unit for adjusting image quality, wherein when said determination unit determines that said consumable is non-genuine, said first image-quality adjustment unit performs an image-quality adjustment suitable for said non-genuine consumable; and a second image-quality adjustment unit for adjusting image quality, wherein when said determination unit determines that said consumable is genuine, said second image-quality adjustment unit performs an image-quality adjustment suitable for said genuine consumable, wherein said consumable includes a toner cartridge filled with toner, said first image-quality adjustment unit adjusts image quality by supplying non-genuine toner that adheres to a first electrostatic latent image including a plural number of strip-shaped pattern images and used for adjusting the image quality, said first electrostatic latent image being formed on a photoreceptor, said second image-quality adjustment unit adjusts image quality by supplying genuine toner that adheres to a second electrostatic latent image including a plural number of strip-shaped pattern images and used for adjusting the image quality, said second electrostatic latent image being formed on a photoreceptor, and an area of pattern image included said first electrostatic latent image is larger than an area of pattern image included said second electrostatic latent image.

3. The image forming apparatus according to claim 1, wherein said first image-quality adjustment unit is activated more often than the second image-quality adjustment unit in a predetermined period.

4. The image forming apparatus according to claim 2, wherein said first image-quality adjustment unit is activated more often than the second image-quality adjustment unit in a predetermined period.

* * * * *